US009990839B2

(12) United States Patent
Venkatesh et al.

(10) Patent No.: US 9,990,839 B2
(45) Date of Patent: Jun. 5, 2018

(54) SYSTEM AND METHOD OF IDENTIFYING A NUMBER OF OCCUPANTS IN A MONITORED REGION FOR EFFECTIVE EMERGENCY EVACUATION AND ASSISTANCE

(71) Applicant: Honeywell International Inc., Morristown, NJ (US)

(72) Inventors: Balamurugan Venkatesh, Hosur (IN); Kiran Reddy Singam, Bangalore (IN); Sameesh Mukundan, Calicut (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 110 days.

(21) Appl. No.: 14/883,210

(22) Filed: Oct. 14, 2015

(65) Prior Publication Data

US 2017/0110000 A1 Apr. 20, 2017

(51) Int. Cl.
*G08B 25/14* (2006.01)
*G08B 21/22* (2006.01)

(52) U.S. Cl.
CPC ..... *G08B 25/14* (2013.01); *G08B 21/22* (2013.01)

(58) Field of Classification Search
CPC ..... G08B 25/10; G08B 25/14; G08B 25/16
See application file for complete search history.

(56) References Cited

U.S. PATENT DOCUMENTS 7,136,999 B1 * 11/2006 Griffiths ..... H04L 63/0492 380/270
2005/0267672 A1 * 12/2005 Holcomb ..... B67D 7/08 701/123
2010/0081411 A1 4/2010 Montenero
2012/0200411 A1 * 8/2012 Best ..... G08G 1/096775 340/539.13
2015/0287296 A1 * 10/2015 Hall ..... G01S 5/0294 340/541

FOREIGN PATENT DOCUMENTS

CN 103686070 A 3/2014

OTHER PUBLICATIONS

English translation of abstract of CN103686070 (A).

* cited by examiner

*Primary Examiner* — Hongmin Fan
(74) *Attorney, Agent, or Firm* — Husch Blackwell LLP

(57) ABSTRACT

When an ambient alarm system detects an alarm condition in the monitored region, the ambient alarm system can transmit a first signal to one or more registered user devices, responsive thereto, the one or more registered user devices can activate a respective Bluetooth peripheral device, the ambient alarm system can initiate a discovery process with the one or more registered user devices, responsive to the discovery process, the respective Bluetooth peripheral device of each of the one or more registered user devices can transmit a respective second signal to the ambient alarm system indicative of a respective identification of a respective one of the one or more registered user devices. Based on a number of received identifications, the ambient alarm system can identify the number of occupants in the monitored region.

12 Claims, 2 Drawing Sheets

SYSTEM AND METHOD OF IDENTIFYING A NUMBER OF OCCUPANTS IN A MONITORED REGION FOR EFFECTIVE EMERGENCY EVACUATION AND ASSISTANCE

FIELD

The present invention relates generally to ambient alarm systems. More particularly, the present invention relates to systems and methods of identifying a number of occupants in a monitored region for effective emergency evacuation and assistance.

BACKGROUND

Ambient alarm systems, such as fire alarm systems, are known in the art. However, during an alarm condition in a monitored region, achieving safe evacuation of all occupants is a challenge, both for the occupants of the region and emergency responders attending the incident. These challenges are magnified more so in high-rise structures that are prevalent in almost every major city across the world.

Designing and constructing the monitored region, such as a building, to achieve total safety in the event of a major fire or other ambient emergency event is near impossible. Indeed, time may not permit safe evacuation to be fully accomplished before lives are lost.

In view of the above, systems and methods are needed to overcome the barriers to safe evacuation that are present in new and existing buildings. For example, it would be helpful if the emergency responders and the like were privy to a headcount distribution of the occupants inside of the building at a given point in time. However, there are currently no known systems and methods to identify such information. Accordingly, there is a continuing, ongoing need for improved systems and methods.

DETAILED DESCRIPTION

Figure 1:
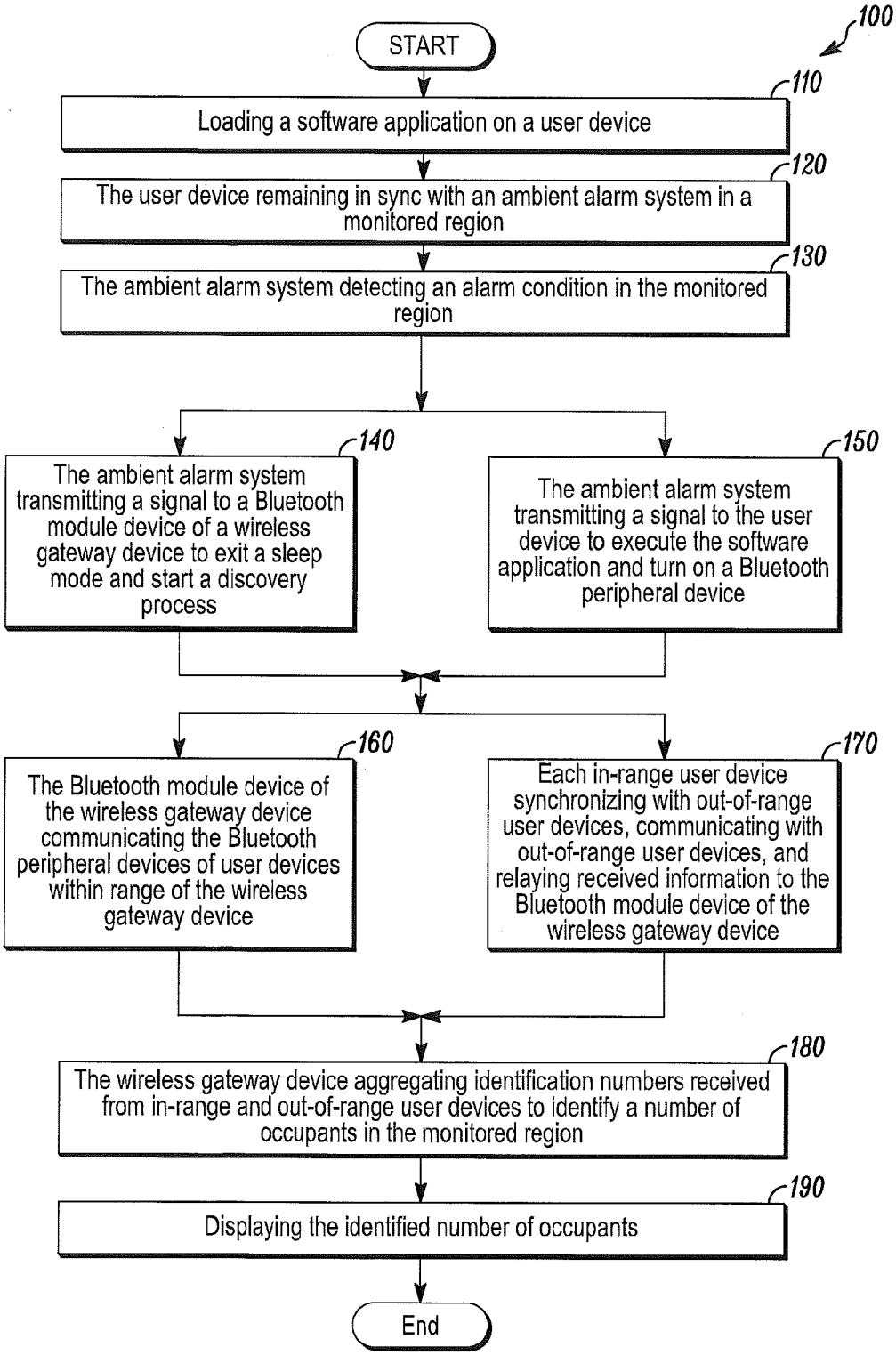
FIG. 1 is a flow diagram of a method in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein include systems and methods of identifying a number of occupants in a monitored region for effective emergency evacuation and assistance. For example, some embodiments disclosed herein can include a gateway device of a wireless ambient alarm system, such as a fire alarm system, and a user device, for example, a smart phone or other personal digital assistant, with a Bluetooth peripheral device. In some embodiments, the gateway device can include a Bluetooth module device for communicating with the user device, and in some embodiments, the user device can include a software application running thereon for executing some of the methods disclosed herein.

Although systems and methods disclosed herein are described in connection with the wireless ambient alarm system, it is to be understood that embodiments disclosed herein are not so limited and can also include a wired ambient alarm system, for example, a wired fire alarm system. In these embodiments, the Bluetooth module device disclosed herein can be part of a fire system loop of a control panel of the wired ambient alarm system, for example, a SLC loop. Furthermore, in these embodiments, the fire system loop can include a plurality of Bluetooth module devices that can be area or zone specific or a beacon for a predetermined number of user devices.

In some embodiments, the software application disclosed herein can include an instant alert software application that can be downloaded to or pre-loaded on the user device. Additionally or alternatively, in some embodiments, the software application disclosed herein can include an emergency mobility software application that can be downloaded to or loaded on the user device when the user device enters the monitored region. For example, in some embodiments, when the user device enters a building, a user can tap the user device to a security device, for example, a security kiosk, and the security device can download the emergency mobility software application to the user device by communicating with the user device via low range wireless data communications technology, including, but not limited to NFC.

After entering the monitored region, the user device can remain in sync with an ambient alarm system in the monitored region. Accordingly, when the ambient alarm system detects an alarm condition, for example, a fire alarm, the ambient alarm system can notify the user device, and the software application running on the user device can turn on the Bluetooth peripheral device of the respective user device. Furthermore, when the ambient alarm system detects the alarm condition, the Bluetooth module device of the gateway device can initiate a discovery process with all user devices in the monitored region.

In some embodiments, during the discovery process, systems and methods disclosed herein can override a default Bluetooth identification of the user device, for example, a default identification name or number or a default Bluetooth identification alphanumeric number, and replace such default Bluetooth identification with an emergency identification, for example, an emergency identification name or number or an emergency identification alphanumeric number. Indeed, in some embodiments, the Bluetooth module device of the gateway device can recognize only detected emergency identifications of registered user devices in the monitored region. Accordingly, systems and methods disclosed herein can identify a number of registered user devices in the monitored region, and accordingly, the number of occupants in the monitored region. Furthermore, during the discovery process, systems and methods disclosed herein can identify probable location details for each of the user devices in the monitored region. For example, systems and methods can determine with which Bluetooth module device of which gateway device in a plurality of gateway devices each of the user devices communicates and identify probable locations of the user devices based on locations of the plurality of gateway devices.

In some situations, the user device in the monitored region may be out of the range of the Bluetooth module device of the gateway device. In these embodiments, an in-range user device can synchronize its discovery process with the discovery process of the Bluetooth module device and communicate with an out-of-range user device using peer-topeer Bluetooth communication. Accordingly, the in-range user device can relay the emergency identification of the out-of-range user device to the Bluetooth module device. In this manner, systems and methods disclosed herein can more accurately identify a number of user devices in the monitored region.

Occupant topography distribution information or headcount distribution information can include the number of user devices identified in the monitored region and the probable locations thereof. In some embodiments, the occupant topography distribution information or the headcount distribution information can be displayed on any device as would be desired by one of ordinary skill in the art. For example, in some embodiments, the occupant topography distribution information or the headcount distribution information can be displayed on an emergency responder's device or on an output device of the ambient alarm system, for example, an annunciator device. Indeed, in some embodiments, the gateway device can include the annunciator device and both the annunciator device and the Bluetooth module device of the gateway device can communicate with the ambient alarm system via a communications bus.

FIG. 1 is a flow diagram of a method 100 in accordance with disclosed embodiments. As seen in FIG. 1, the method 100 can include loading a software application on a user device as in 110. For example, loading the software application on the user device as in 110 can include pre-loading the software application on the user device or a security device at an entrance of a monitored region downloading the software application to the user device upon the user device coming within a predetermined distance of the security device.

After the software application is loaded on the user device as in 110, the method 100 can include the user device remaining in sync with an ambient alarm system in the monitored region as 120. Upon the ambient alarm system detecting an alarm condition in the monitored region as in 130, the method 100 can include the ambient alarm system transmitting a signal to a Bluetooth module device of a wireless gateway device with instructions to exit a sleep mode and start a discovery process as in 140 and the ambient alarm system transmitting a signal to the user device with instructions to execute the software application running thereon and to turn on a Bluetooth peripheral device of the user device as in 150. In some embodiments, the user device executing the software application running thereon as in 150 can include the software application overriding a default identification of the user device or the Bluetooth peripheral device with a predetermined emergency identification that is recognizable by the Bluetooth module device of the wireless gateway device.

As seen in FIG. 1, after the Bluetooth module device of the wireless gateway device exits the sleep mode as in 140 and after the Bluetooth peripheral device of the user devices is turned on as in 150, the method 100 can include the Bluetooth module device of the wireless gateway device communicating with Bluetooth peripheral devices of all user devices within range of the wireless gateway device to identify an identification, for example, an emergency identification name, number, or alphanumeric number, of each of such in-range user devices as in 160. In some embodiments, the Bluetooth module device as disclosed herein can identify detected identifications that are not associated with a registered one of the user devices and discard such identifications for subsequent headcount identification. For example, the Bluetooth module device can identify non-emergency identifications and discard the same.

While the Bluetooth module device of the wireless gateway is communicating with the Bluetooth peripheral devices of the in-range user devices as in 160, the method 100 can include each of the in-range user devices synchronizing with out-of-range user devices, communicating with such out-of-range user devices to identify an identification, for example, an emergency identification, name, number, or alphanumeric number, of each of the out-of-range user devices, and relaying any such identifications to the Bluetooth module device of the wireless gateway device as in 170. In some embodiments, the software application running on each of the in-range user devices or the Bluetooth peripheral device of each of the in-range user devices can identify detected identifications that are not associated with a registered one of the out-of-range user devices and discard such identifications for subsequent headcount identification. For example, the software application running on each of the in-range user devices or the Bluetooth peripheral device of each of the in-range user devices can identify non-emergency identifications and discard the same.

As seen in FIG. 1, the method 100 can include the wireless gateway device aggregating the detected identifications received from both the in-range user devices and the out-of-range user devices to identify a number of occupants in the monitored region as in 180. Indeed, a number of Bluetooth peripheral devices and user devices discovered by the Bluetooth module device of the wireless gateway device, either directly or via another user device, can be proportional to the number of occupants inside of the monitored region. Then, the method 100 can include displaying the number of occupants as in 190. For example, in some embodiments, the method 100 can include displaying the number of occupants on a user interface device of an annunciator device or on a user interface device of an emergency responder's device.

It is to be understood that some systems and methods disclosed herein can include a plurality of wireless gateway devices, each of which can include a Bluetooth module device. In these embodiments, the Bluetooth module device of each of the plurality of wireless gateway devices and each of the plurality of wireless gateway devices can execute the method 100 as described above. Then, each of the plurality of wireless gateway devices can transmit a signal to a central device of the ambient alarm system indicative of identifications identified by that one of the plurality of wireless gateway devices. The central device can filter the identifications received from each of the plurality of wireless gateway devices to delete duplicates and aggregate a total number of unique identifications to identify the number of occupants in the monitored region.

Figure 2:
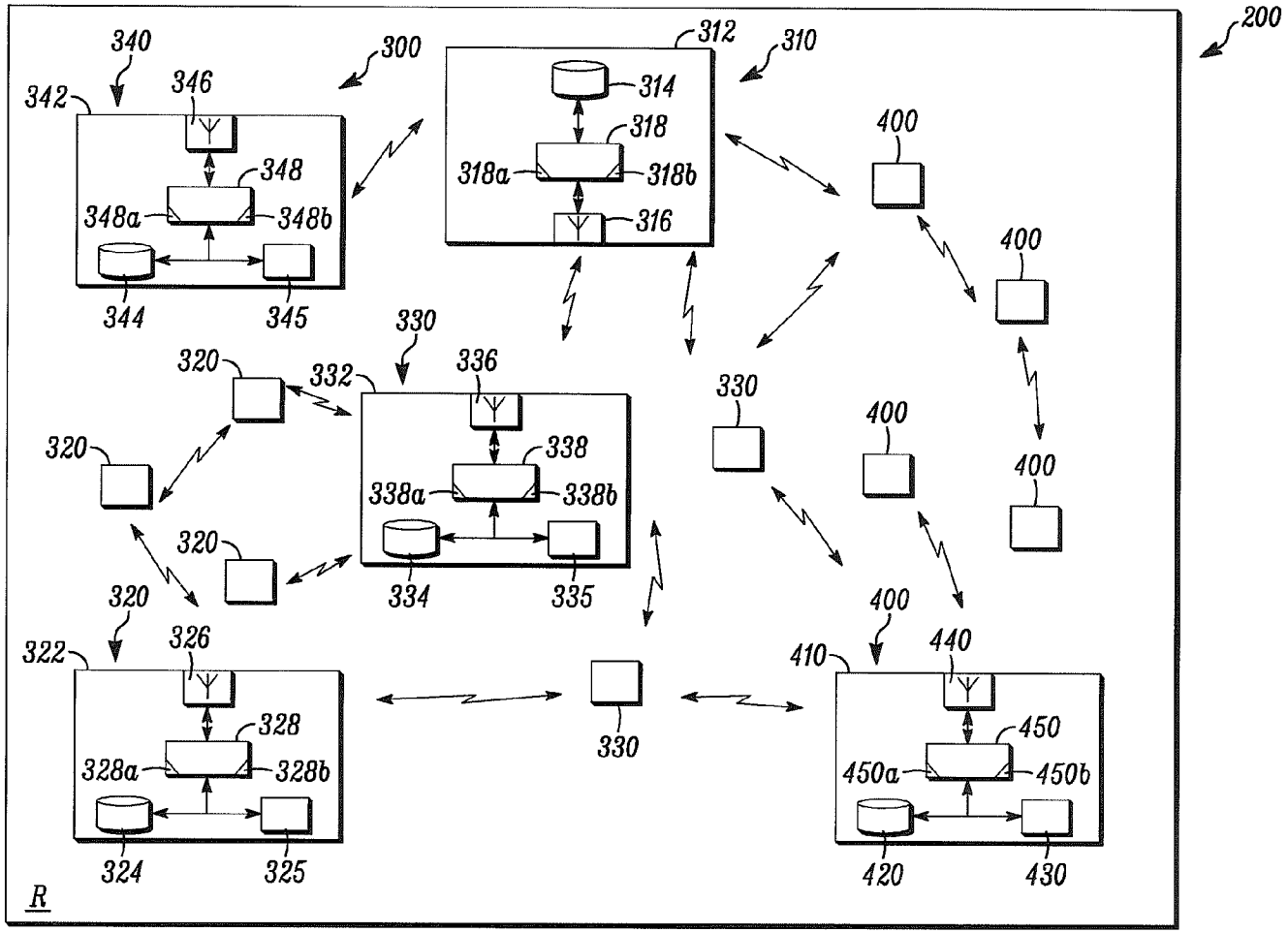
FIG. 2 is a block diagram of a system in accordance with disclosed embodiments.

FIG. 2 is a block diagram of a system 200 in accordance with disclosed embodiments. As seen in FIG. 2, the system 200 can include an ambient alarm system 300 in a monitored region R and a plurality of user devices 400 in the monitored region.

The ambient alarm system 300 can include a central control panel device 310, one or more ambient condition detector devices 320, one or more wireless gateway devices 330, and one or more display devices 340. Each of the ambient condition detector devices 320 can communicate with the central control panel device 310 via one of the wireless gateway devices 330.

As seen in FIG. 2, the central control panel device 310 can include a housing 312, a memory device 314, a transceiver 316, control circuitry 318, one or more programmable processors 318*a*, and executable control software 318*b* as would be understood by one of ordinary skill in the art. The executable control software 318*b* can be stored on a transitory or non-transitory computer readable medium, including, but not limited to local computer memory, RAM, optical storage media, magnetic storage media, flash memory, and the like. In some embodiments, the control circuitry 318, the programmable processors 318*a*, and the control software 318*b* can execute and control some of the methods as described above and herein.

As further seen in FIG. 2, each of the ambient condition detector devices 320 can include a housing 322, a memory device 324, an ambient condition sensor 325, a transceiver 326, control circuitry 328, one or more programmable processors 328*a*, and executable control software 328*b* as would be understood by one or ordinary skill in the art. The executable control software 328*b* can be stored on a transitory or non-transitory computer readable medium, including, but not limited to local computer memory, RAM, optical storage media, magnetic storage media, flash memory, and the like. In some embodiments, the control circuitry 328, the programmable processors 328*a*, and the control software 328*b* can execute and control some of the methods as described above and herein.

As further seen in FIG. 2, each of the wireless gateway devices 330 can include a housing 332, a memory device 334, a Bluetooth module device 335 or adaptor, a transceiver 336, control circuitry 338, one or more programmable processors 338*a*, and executable control software 338*b* as would be understood by one or ordinary skill in the art. It is to be understood that the Bluetooth module device 335 can include a Bluetooth transceiver that may be separate from the transceiver 336. The executable control software 338*b* can be stored on a transitory or non-transitory computer readable medium, including, but not limited to local computer memory, RAM, optical storage media, magnetic storage media, flash memory, and the like. In some embodiments, the control circuitry 338, the programmable processors 338*a*, and the control software 338*b* can execute and control some of the methods as described above and herein.

The display device 340 can include a housing 342, a memory device 344, a user interface device 345, a transceiver 346, control circuitry 348, one or more programmable processors 348*a*, and executable control software 348*b* as would be understood by one or ordinary skill in the art. The executable control software 348*b* can be stored on a transitory or non-transitory computer readable medium, including, but not limited to local computer memory, RAM, optical storage media, magnetic storage media, flash memory, and the like. In some embodiments, the control circuitry 348, the programmable processors 348*a*, and the control software 348*b* can execute and control some of the methods as described above and herein. Although the display device 340 is shown as a standalone device in FIG. 2, it is to be understood that the display device 340 can additionally or alternatively be part of the central control panel device 310, one of the ambient condition detector devices 320, one of the wireless gateway devices 330, an emergency responder's device, such as a smart phone, or any other output device inside or outside of the monitored region R, such as an annunciator device.

As seen in FIG. 2, each of the plurality of user devices 400 can include a housing 410, a memory device 420, a Bluetooth peripheral device 430, a transceiver 440, control circuitry 450, one or more programmable processors 450*a*, and executable control software 450*b* as would be understood by one or ordinary skill in the art. It is to be understood that the Bluetooth peripheral device 430 can include a Bluetooth transceiver that may be separate from the transceiver 440. It is also to be understood that the executable control software 450*b* can include the instant alert software application or the emergency mobility software application described above. The executable control software 450*b* can be stored on a transitory or non-transitory computer readable medium, including, but not limited to local computer memory, RAM, optical storage media, magnetic storage media, flash memory, and the like. In some embodiments, the control circuitry 450, the programmable processors 450*a*, and the control software 450*b* can execute and control some of the methods as described above and herein.

In some embodiments, the executable control software 450*b* can be loaded on each of the user devices 400, and each of the user devices 400 can remain in sync with the ambient alarm system 300, including the central control panel device 310. When at least one of the ambient condition detector devices 320 detects an alarm condition in the monitored region R, that ambient condition detector device 320 can transmit a signal to one of the wireless gateway devices 330, which can relay the signal to the central control panel device 310. When the wireless gateway device 330 receives the signal from the ambient condition detector device 320, the wireless gateway device 330 can cause its Bluetooth module device 335 to exit a sleep mode and start a discovery process. Furthermore, when the central control panel device 310 receives the signal from the wireless gateway device 330, the central control panel device 310 can transmit a signal to each of the other wireless gateway devices 330 to cause the Bluetooth module devices 335 of the wireless gateway devices 330 to exit a sleep mode and start the discovery process. The central control panel device 310 can also transmit a signal to each of the user devices 400 in the monitored region R to cause the user devices 400 to execute the executable control software 450*b* running thereon and to turn on their Bluetooth peripheral devices 430.

During the discovery process, each of the Bluetooth module devices 335 can communicate with the Bluetooth peripheral devices 430 of the user devices 400 within a predetermined range thereof to transmit signals indicative of identifications of in-range ones of the user devices 400 to its wireless gateway device 330. During the discovery process, each of the Bluetooth peripheral devices 430 of the user devices 400 within the predetermined range of one of the Bluetooth module devices 335 can also communicate with the Bluetooth peripheral devices 430 of the user devices 400 outside of the predetermined range of the Bluetooth module devices 335 in the monitored region R to relay signals indicative of identifications of such out-of-range user devices 400 to one of the wireless gateway devices 330. Accordingly, each of the wireless gateway devices 330 can identify at least some of the identifications of the user devices 400 in the monitored region R.

Each of the wireless gateway devices 330 can transmit a signal indicative of received identifications to the central control panel device 310, which can filter the received identifications to delete duplicates and aggregate a total number of unique identifications to identify a number of occupants in the monitored region R. The central control panel device 310 can also identify probable locations of the occupants based on locations of the wireless gateway devices 330 that transmitted signals indicative of the identifications of the user devices 400 to the central control panel device 310. Finally, the central control panel device can transmit a signal to the display device 340 with instructions for displaying, on the user interface device 345, an indication of the number of occupants in the monitored region R and the probable locations thereof.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

a gateway device receiving a first signal indicative of an alarm condition in a monitored region;

responsive to receiving the first signal, the gateway device initiating a discovery process with a plurality of registered user devices in the monitored region;

responsive to initiating the discovery process, each of the plurality of registered user devices replacing a respective default identification with a respective emergency identification;

the gateway device receiving a respective second signal from each of the plurality of registered user devices in the monitored region, the respective second signal indicative of the respective emergency identification for a respective one of the plurality of registered user devices; and based on the respective second signal indicative of the respective emergency condition received from a number of the plurality of registered user devices, the gateway device identifying a number of occupants in the monitored region.

2. The method of claim 1 wherein the gateway device receiving the first signal includes the gateway device receiving the first signal from an ambient condition detector device in the monitored region or the gateway device receiving the first signal from a central control panel device in the monitored region.

3. The method of claim 1 further comprising, responsive to receiving the first signal, the gateway device causing a Bluetooth module device to exit a sleep mode.

4. The method of claim 1 wherein the respective second signal received from each of the plurality of registered user devices in-range of the gateway device is received directly by the gateway device.

5. The method of claim 4 wherein the respective second signal received from each of the plurality of registered user devices out-of-range of the gateway device is received from one of the plurality of user devices in-range of the gateway device.

6. The method of claim 1 wherein the gateway device identifying the number of occupants in the monitored region includes the gateway device transmitting a third signal indicative of the number of the plurality of registered devices from which the respective second signal indicative of the respective emergency condition is received to a central control panel device for identifying the number of occupants in the monitored region.

7. The method of claim 6 further comprising identifying a respective location of each of the plurality of registered user devices in the monitored region based on an origin location of the third signal transmitted to the central control panel device.

8. The method of claim 1 further comprising transmitting a third signal with instructions to display an indication of the number of occupants in the monitored region.

9. A system comprising:

an ambient alarm system in a monitored region; and one or more registered user devices in the monitored region, wherein, when the ambient alarm system detects an alarm condition in the monitored region, the ambient alarm system transmits a first signal to the one or more registered user devices, and responsive thereto, each of the one or more registered user devices activates a respective Bluetooth peripheral device, wherein each of the one or more registered user devices activating the respective Bluetooth peripheral device includes each of the one or more registered user devices replacing a respective default identification with a respective emergency identification, wherein, when the ambient alarm system detects the alarm condition in the monitored region, the ambient alarm system initiates a discovery process with the one or more registered user devices, wherein, responsive to the discovery process, the respective Bluetooth peripheral device of each of the one or more registered user devices transmits a respective second signal to the ambient alarm system indicative of the respective emergency identification for a respective one of the one or more registered user devices, and wherein, based on the respective second signal indicative of the respective emergency condition received from the respective Bluetooth peripheral device of a number of the one or more registered user devices, the ambient alarm system identifies a number of occupants in the monitored region.

10. The system of claim 9 wherein the ambient alarm system disregards non-emergency identifications.

11. A system comprising:

an ambient alarm system in a monitored region; and one or more registered user devices in the monitored region, wherein, when the ambient alarm system detects an alarm condition in the monitored region, the ambient alarm system transmits a first signal to the one or more registered user devices, and responsive thereto, each of the one or more registered user devices activates a respective Bluetooth peripheral device, wherein, when the ambient alarm system detects the alarm condition in the monitored region, the ambient alarm system initiates a discovery process with the one or more registered user devices, wherein, responsive to the discovery process, the respective Bluetooth peripheral device of each of the one or more registered user devices transmits a respective second signal to the ambient alarm system indicative of a respective identification for a respective one of the one or more registered user devices, wherein, based on the respective second signal received from the respective Bluetooth peripheral device of a number of the one or more registered user devices, the ambient alarm system identifies a number of occupants in the monitored region, and wherein the respective Bluetooth peripheral device of each of the one or more registered devices in-range of the ambient alarm system synchronizes with the respective Bluetooth peripheral device of at least one of the one or more registered devices out-of-range of the ambient alarm system, receives a respective identification signal from the Bluetooth peripheral device of the at least one of the one or more registered devices out-of-range of the ambient alarm system, and relays the respective identification signal from the Bluetooth peripheral device of the at least one of the one or more registered devices out-of-range of the ambient alarm system to the ambient alarm system in the respective second signal transmitted by the respective Bluetooth peripheral device of the respective one of the one or more registered user devices in-range of the ambient alarm system.

12. The system of claim 9 wherein the ambient alarm system identifies a respective location of each of the one or more registered user devices based on an origin location of the respective second signal received from the respective Bluetooth peripheral device of the respective one of the one or more registered devices.

* * * * *